United States Patent [19]

Schachl et al.

[11] 4,330,910

[45] May 25, 1982

[54] DEVICE AND METHOD FOR SMOOTHENING SURFACES OF DISKS FOR DISK MEMORIES

[75] Inventors: Rudolf Schachl, Taufkirchen; Hans-Heinrich Gatzen, Munich, both of Fed. Rep. of Germany

[73] Assignee: Siemens Aktiengesellschaft, Berlin & Munich, Fed. Rep. of Germany

[21] Appl. No.: 183,923

[22] Filed: Sep. 4, 1980

[30] Foreign Application Priority Data

Sep. 14, 1979 [DE] Fed. Rep. of Germany ..... 2937276

[51] Int. Cl.[3] ..... B21C 37/30

[52] U.S. Cl. ..... 29/90 R

[58] Field of Search ..... 29/90 R

[56] References Cited

U.S. PATENT DOCUMENTS

| | | | |
|---|---|---|---|
| 442,283 | 12/1890 | Bentor | 29/90 R |
| 1,516,268 | 11/1924 | Drissner | 29/90 R |
| 2,296,883 | 9/1942 | Trask | 29/90 R |

OTHER PUBLICATIONS

IBM Technical Disclosure Bulletin, vol. 17, No. 10, p. 3010, (Mar. 1975).

*Primary Examiner*—Harrison L. Hinson

*Attorney, Agent, or Firm*—Hill, Van Santen, Steadman, Chiara & Simpson

[57] ABSTRACT

Disk surfaces for magnetic disk memories used in data processing systems are smoothened by a burnishing-like device consisting of a circular-cylindrical-shaped body (sliding block) having opposing flat base surfaces with at least one sharp-edged groove positioned on at least one of the base surfaces. This smoothening device is pressed manually or by a support mount similar to a magnetic data-head support mount of a magnetic disk memory against a disk surface while relative motion is provided between the device and the disk whereby the groove edges contact any surface irregularities on a disk surface being smoothened while the flat areas between the groove edges prevent undue disk surface damage.

8 Claims, 2 Drawing Figures

DEVICE AND METHOD FOR SMOOTHENING SURFACES OF DISKS FOR DISK MEMORIES

BACKGROUND OF THE INVENTION

1. Field of the Invention

The invention relates to means for smoothening (burnishing) surfaces of disks for disk memories and somewhat more particularly to a device and method for smoothening operational surfaces of magnetic disks for magnetic disk memories, as are used in data processing systems.

2. Prior Art

In order to scan memory disks in magnetic disk memories for data processing systems with magnetic heads having altitude levels of less than 1 μm, a very low degree of roughness on the disk surface, far below 1 μm, is required. Such degree of roughness is significantly below that presently attainable in the manufacture of such disks. The surface error or irregularities in the form of projecting peaks and the like typically present after disk manufacture, must be eliminated by a subsequent work-step, during which the projecting peaks and the like are eroded or levelled.

It is known to level or burnish the planar surfaces of such disks by means of special "burnishing heads" which scan the operative disk surface at reduced speeds and at altitude levels which are far below normal operating speeds and altitude levels of magnetic heads. Due to the reduced speed and low altitude level utilized during such burnishing or smoothening process, a contact occurs at uneven surface areas between the burnishing head and the disk surface being scanned. This contact causes the roughness areas to be either eroded or levelled.

With the foregoing arrangement, the burnishing head may be equipped with a piezo-electric element which generates an impulse-like signal upon contact between the burnishing head and the disk surface. The disk is considered to be smoothened (burnished) when such signals attain a minimum value or are no longer generated.

A disadvantage of the foregoing procedure for smoothening the surfaces of disk memories is that the burnishing heads still fly too high and thus fail to achieve an optimum smoothening. If one were to further reduce the disk speed so as to further reduce the altitude level of the burnishing heads, insufficient energy for the desired smoothening would result.

SUMMARY OF THE INVENTION

The invention provides a device and method for smoothening surfaces of disks for disk memories which avoids and/or minimizes the above-noted prior art disadvantages.

In accordance with the principles of the invention, a circular-cylindrical-shaped body (sometimes referred to as a sliding block) having substantially flat base surfaces with at least one sharp-edged groove arranged on at least one of the base surfaces is pressed against an operative memory disk surface to be smoothened, either manually or by a support mount similar to a magnetic data-head support mount for magnetic disk memories while relative motion is provided between such sliding block and disk surface so that a smoothening of the disk surface occurs.

In preferred embodiments of the invention, at least two intersecting grooves are arranged on at least one of the base surface of the circular-cylindrical-shaped body. In certain preferred embodiments of the invention, the outer edges of the circular-cylindrical-shaped body are relieved or rounded-off. In certain preferred embodiments of the invention, the circular-cylindrical-shaped body is composed of aluminum oxide ($Al_2O_3$).

A smoothening (burnishing) process conducted in accordance with the principles of the invention comprises pressing a circular-cylindrical-shaped body (sliding block) having opposing substantially planar surfaces with at least one sharp-edge groove positioned on at least one of such planar surfaces against an operative surface of a memory disk to be smoothened so that a planar surface of such body having said groove thereon is in contact with the operative surface of the memory disk while substantially simultaneously providing relative motion between such sliding block and such disk.

In certain embodiments of the invention, the surface of the disk being smoothened can be scanned with a magnetic data head equipped with a piezo-electric element at that radius of such disk surface at which the sliding block just happens to be located at while monitoring electrical signals generated by such piezo-electric element during contact between the data head and the disk being smoothened until a desired number of signals are noted (i.e., zero or some minimum value). The magnetic data head equipped with a piezo-electric element is matched in its flight properties so that they coincide with those of a data head which is later to scan the disk during normal operation. In this manner one can readily determine whether a normal data head makes adequate contact with the disk surface during normal operations.

DESCRIPTION OF PREFERRED EMBODIMENTS

The invention provides an improved smoothening device and method of operating the same for smoothening surfaces of disks for disk memories.

In accordance with the principles of the invention, such smoothening device comprises a circular-cylindrical-shaped body (sliding block) having opposing planar base surfaces with at least one sharp-edged groove positioned on at least one of such base surfaces.

In operation, such improved smoothening device is pressed against a memory disk surface to be smoothened, either by hand or in a support mount similar to a magnetic data-head support mount of magnetic disk memories while relative motion is provided between such smoothening device and disk surface. With either method, axial pressure is applied against one surface of the smoothening device and causes the opposite surface to contact at least some areas of the disk being smoothened so that by providing relative motion between the disk and the smoothening body, any surface irregularities on the disk surface (which is typically composed of material softer than that forming the smoothening body) are removed.

Figure 1:
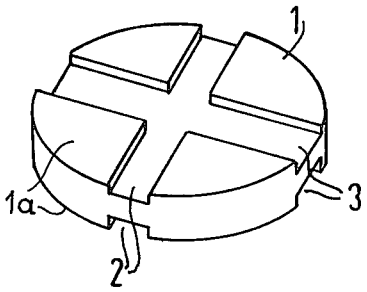
FIG. 1 is a somewhat elevated perspective view of an embodiment of a smoothening device constructed and operable in accordance with the principles of the invention.

FIG. 1 illustrates a circular-cylindrical-shaped body 1, sometimes referred to as a sliding block, having two intersecting sharp-edged grooves 2 and 3 positioned on opposite planar base surfaces 1*a* thereof. In certain embodiments, the circular-cylindrical-shaped body 1 can be provided with only a single sharp-edged groove 2*a* on one of the base surfaces thereof, such as shown at FIG. 2.

However, the provision of two or more intersecting sharp-edged grooves is preferred because with such an arrangement, a plurality of sharp edges are attained in the work area of a base surface of the sliding block or circular-cylindrical-shaped body 1. Further, when, as shown, such sharp-edge grooves 2 and 3 are positioned not only on a given base surface, but also on the opposite base surface, then it is possible to smoothen disk surfaces with the same sliding block or smoothening device for longer periods of time, simply by changing sides on the sliding block.

Figure 2:
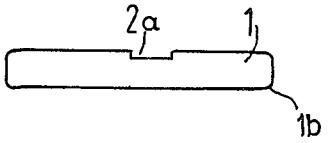
FIG. 2 is an elevated side view of another embodiment of a smoothening device constructed and operable in accordance with the principles of the invention.

In certain preferred embodiments of the invention, it is advantageous to round-off the outer edges 1*b* of the circular-cylindrical body 1 and to only provide sharp-edges along the peripheries of, for example, groove 2 (FIG. 2). This arrangement prevents the sliding block or smoothening body 1 from digging into the disk surfaces with its outer edges and thereby damaging the disk surface when a given planar surface of the body 1 is pressed against a disk surface being smoothened.

The circular-cylindrical-shaped body or sliding block 1 is preferably composed of aluminum oxide ($Al_2O_3$).

Since the work surfaces of the circular-cylindrical-shaped body 1 are essentially planar and have sharp edges along interior areas thereof, i.e., in the area of the groove peripheries, and such body does not fly above the surface of the disk being smoothened but, rather, slides along such surface itself, any irregularities or the like present on the disk surface are eroded or levelled with a significant greater certainty than is attainable with the use of known burnishing heads.

The effectiveness of a smoothening operation occurring with the aid of the inventive sliding block can be monitored by equipping a data-head (which is matched in its flight properties so that such properties coincide with the flight properties of a data-head which is later to scan the disk surface in normal operation) with a piezo-electric element and causing such special data-head to scan the disk surface being smoothened at a radius thereof at which the sliding block happens to be located at. In this manner, one can readily determine whether the surface quality of the disk being smoothened is adequate or if it still needs improvement, because, of course, given such special data-head with a piezo element thereon, an electrical signal is emitted at each contact between such data-head and disk surface, which can readily be monitored. Once such signals are no longer emitted or a minimum number of signals are generated, the disk surface is deemed to be sufficiently smooth for normal operation.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. A device for smoothening (burnishing) operative surfaces of disks for disk memories such as magnetic disks for magnetic disk memories, comprising:

a circular-cylindrical-shaped body having opposed planar base surfaces; and at least one sharp-edged groove positioned on at least one of said planar base surfaces.

2. A device as defined in claim 1 wherein at least two intersecting sharp-edge grooves are positioned on at least one of said planar base surfaces.

3. A device as defined in claim 1 wherein said sharp-edged groove is positioned on both of said opposing planar base surfaces.

4. A device as defined in claim 1 wherein outer edges of said circular-cylindrical-shaped body are rounded-off.

5. A device as defined in claim 1 wherein said body is composed of aluminum oxide.

6. A method of smoothening (burnishing) operative surfaces of magnetic disks for magnetic disk memories, comprising:

mounting a circular-cylindrical-shaped body having opposing planar base surfaces with at least one sharp-edged groove positioned on at least one of such planar surfaces in a support mount similar to a magnetic data-head support mount of a magnetic disk memory so that a planar base surface of said body having said groove therein is uncovered;

contacting said uncovered planar surface having said groove therein with an operative surface of a magnetic disk requiring smoothening; and pressing said circular-cylindrical-shaped body via said support means against said operative surface of the magnetic disk while substantially simultaneously providing relative motion between said body and said disk.

7. A method of smoothening (burnishing) operative surfaces of magnetic disks for magnetic disk memories, comprising:

manually pressing a circular-cylindrical-shaped body having opposing planar base surfaces with at least one sharp-edged groove positioned on at least one such planar surface against an operative surface of a magnetic disk requiring smoothening so that a planar surface of said body having said groove therein is in contact with said disk surface, and providing relative motion between said body and said disk.

8. A method of smoothening (burnishing) operative surfaces of magnetic disks for magnetic disk memories, comprising:

pressing a circular-cylindrical-shaped body having opposing planar surfaces with at least one sharp-edged groove positioned on at least one of such planar surfaces against an operative surface of a magnetic disk to be smoothened so that a planar surface of such body having said groove therein is in contact with said operative surface of the magnetic disk while providing relative motion between said body and said disk;

scanning the surface of the disk being smoothened with a magnetic data-head equipped with a piezo-electric element at the radius of such disk surface at which said body just happens to be located at, said data-head being equipped with a piezo-electric element being matched in its flight properties to the flight properties of a standard data-head which is later to scan the disk surface in normal operation; and monitoring electrical signals generated by said piezo-electric element during contact between said data-head equipped with said piezo-electric element and said disk being scanned until a desired number of signals are attained.

* * * * *